United States Patent [19]

Narisoko et al.

[11] Patent Number: 4,744,312

[45] Date of Patent: May 17, 1988

[54] METHOD OF PROMOTING SECONDARY COMBUSTION IN A FLUIDIZED BED INCINERATOR

[75] Inventors: Minoru Narisoko, Matsudo; Satoshi Inoue, Asaka, both of Japan

[73] Assignee: Ishikawajima-Harima Heavy Industries Co., Ltd., Tokyo, Japan

[21] Appl. No.: 5,176

[22] Filed: Jan. 20, 1987

[30] Foreign Application Priority Data

Jan. 21, 1986 [JP] Japan ..... 61-8946

[51] Int. Cl.[4] ..... F23G 5/00; F23G 7/00

[52] U.S. Cl. ..... 110/245; 110/346

[58] Field of Search ..... 110/245, 346, 347; 431/7; 165/104.16

[56] References Cited

U.S. PATENT DOCUMENTS 3,397,657 8/1968 Tada ..... 110/245
4,060,041 11/1977 Sowards ..... 110/245
4,295,817 10/1981 Caplin et al. ..... 431/7
4,377,119 3/1983 Noack ..... 110/245 X
4,548,138 10/1985 Korenberg ..... 110/245

*Primary Examiner*—Edward G. Favors
*Attorney, Agent, or Firm*—Cullen, Sloman, Cantor, Grauer, Scott & Rutherford

[57] ABSTRACT

A method for combusting combustible gases generated by thermal decomposition of refuse in a fluidized bed incinerator is disclosed. The refuse is fluidized, together with a fluidizing medium such as sand, by the primary air, burned and decomposed. The pyrolysis gas produced by the decomposition of the refuse is completely burned by the secondary air introduced into the combustion chamber of the incinerator in a grid-shaped pattern, in multiple stages. The noncombustible gas and smut densities within exhaust gas are also reduced. Additionally, the combustion chamber temperature can be maintained at a high level as a result of the secondary combustion being carried out quickly.

19 Claims, 4 Drawing Sheets

(PRIOR ART)

METHOD OF PROMOTING SECONDARY COMBUSTION IN A FLUIDIZED BED INCINERATOR

TECHNICAL FIELD

This invention relates to a method of incinerating substances as municipal industrial wastes (called "refuse" hereinafter) while fluidizing them in a fluidized bed. More particularly, it is concerned with a method of promoting secondary combustion in a fluidized bed incinerator for post-combusting in the upper part of the incinerator the combustible pyrolysis gas which is produced by burning and decomposing the refuse in the fluidized bed.

BACKGROUND ART

The fluidized bed incinerator is known for incinerating and disposing of refuse such as municipal waste. The method of incineration and disposition of the refuse in the fluidized bed incinerator is to burn the refuse while fluidizing it with air inside the incinerator. In order to improve the fluidization and combustion of the refuse, a fluidizing medium such as sand is fed together with the refuse into the fluidized bed.

A typical type of fluidized bed incinerator is equipped with a number of air diffuser tubes or air diffuser plates (called "air diffusers" hereinafter) for blowing air into the lower section of the incinerator body, and further, the upper section of the incinerator body is equipped with a refuse feeding unit and a fluidizing medium feeding unit.

The refuse is burned while both the refuse and the fluidizing medium are deposited onto the air diffusers inside the incinerator body where they are fluidized by the primary air blown from the air diffusers.

The refuse generally contains a variety of materials such as low calorie refuse such as discarded food, high calorie refuse such as plastics and rubber, refuse such as shredded or chipped furniture, or refuse such as fragmented metallic or vitreous containers, bottles or cans.

As the refuse is fed to the fluidized bed, the combustibles are burned, of which plastics and similar substances are melted by heat to generate pyrolysis gas, and the incombustibles such as metal and glass remain unburned (called "combustion residue" hereinafter).

As the fluidizing medium is gradually fed to the fluidized bed, a moving bed of fluidizing medium descends. Therefore, while the combustibles are being burned or decomposed within the fluidized bed, the combustion residue, together with the fludizing medium, descends down through the gaps between the air diffuser tubes at the lower section of the fluidized bed. The fluidizing medium is then separated from combustion residue, and is again fed to the fluidized bed.

Secondary air is supplied to the upper section of the fluidized bed, where the generated pyrolysis gases are burned. Because, in this type of fluidized bed incinerator, the sand which is deposited onto the fluidized bed as the fluidizing medium is oscillated while it descends and is heated, the agitation and dispersion of the refuse is promoted.

For this reason, the refuse deposited onto the fluidized bed is dispersed uniformly in the presence of fluidizing medium and is dried, ignited, decomposed, and burned instantaneously. Further, the ash and dust produced therein are drawn along with the fluidizing air, out of the upper section of the incinerator and are collected by an electric precipitator.

Consequently, the refuse deposited onto the fluidized bed is disposed of almost completely, leaving behind some metallic, vitreous, or ceramic residue. The ratio of these substances to the refuse is usually 2%, and therefore a fluidized bed incinerator can dispose of 98% of the refuse.

A primary advantage of the fluidized bed is that it can reduce the volume of combustion residue to $\frac{1}{3}$ compared to a conventional mechanical incinerator such as a stoker-type incinerator.

A problem exists, however, with fluidized bed incinerators in that the refuse deposited onto the fluidized bed is burned and decomposed at a speed so high that the refuse cannot be stably combusted. The refuse has different caloric value depending on the particular content of refuse, and it is often difficult to supply a constant volume of the refuse to the fluidized bed. For example, suppose that a large amount of the refuse is deposited at the same time onto the fluidized bed; in this event, a large quantity of pyrolysis gas and smut are also generated simultaneously even though the refuse is burned and decomposed instantaneously. In this instance, not only is it impossible to completely secondarily combust the resulting large quantity of pyrolysis gas with secondary air inside the incinerator, but it is also difficut to entirely collect the large quantity of smut contained in the exhaust gas by means of an electric precipitator.

The principal object of this invention is to provide a method for burning and decomposing the refuse slowly inside the fluidized bed incinerator, for secondarily combusting the generated combustible gases in the upper section of the incinerator, for improving the combustion of the mixture of combustible gas and secondary air, and for maintaining the temperature of the combustible gas in the incinerator at a high level.

An additional object is to slow the combustion of refuse in the fluidized bed by injecting the secondary air into the combustion chamber in order to carry out secondary combustion.

SUMMARY OF THE INVENTION

In accordance with the present invention, refuse such as municipal waste is fluidized with a fluidizing medium and primary air which are supplied into the fluidized bed incinerator. The refuse is burned and decomposed in the fluidized bed. Secondary air is blown into the combustion chamber at the upper section of the incinerator, in order to secondarily combust the combustible gases which are produced by the thermal decomposition of the refuse. The secondary air is blown into the combustion chamber from a group of nozzles which are arranged in multiple vertical stages. The nozzles of each stage are arranged parallel to each other in the horizontal direction and are positioned on at least one side of the incinerator wall so that the secondary air from each nozzle flows horizontally across the combustion chamber.

DESCRIPTION OF THE PREFERRED EMBODIMENTS

Hereinafter, the preferred embodiment example of the secondary combustion promotion method for a fluidized bed incinerator according to this invention will be described with reference to the accompanying drawings.

Figure 1:
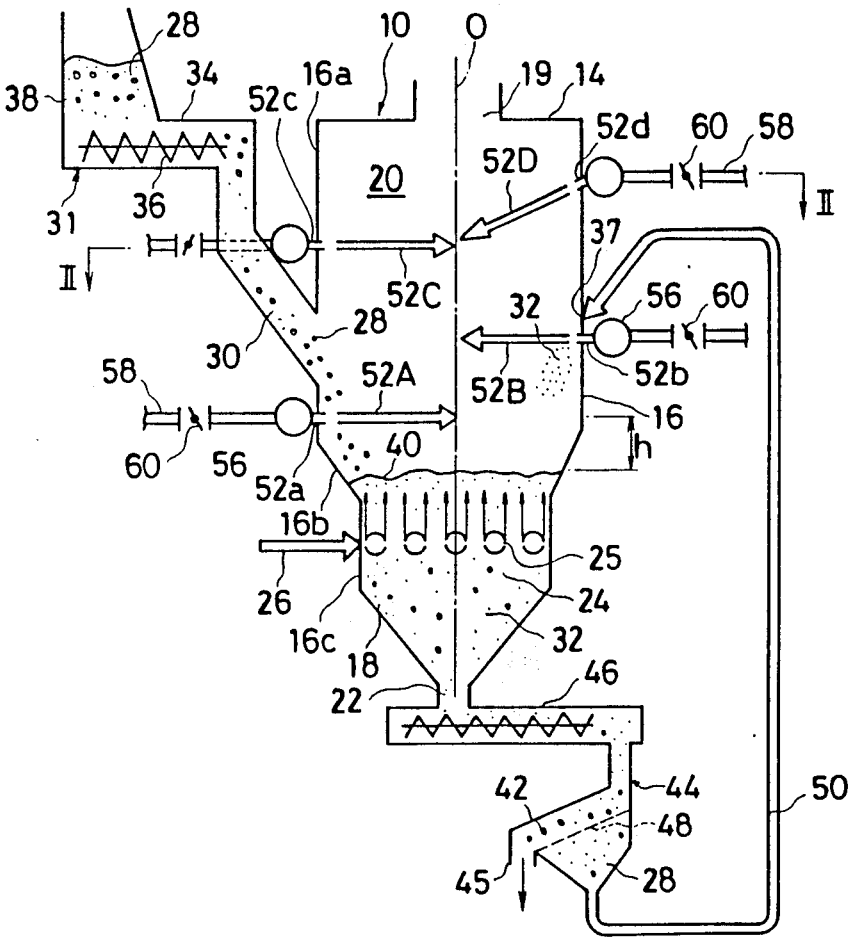
FIG. 1 is a schematic sectional view of a fluidized bed incinerator, according to this invention.

In FIG. 1, the reference numeral 10 indicates an incinerator body made up of refractory walls 12, and which comprises a rectangular wall 14, side walls 10 and an inverted rectangular pyramidal bottom wall 18 connected to the lower section of the side walls 16. The side walls 16 comprise upper wall 16*a* in which a combustion chamber 20, described later, is formed, wall 16*b*, which is inclined inwardly from the upper wall 16*a* and vertical wall 16*c*, extending vertically from the lower section of the inclined wall 16*b* and connected with the bottom wall 18.

An exhaust port 19 is provided on the top wall 14, and a discharge port 22 is provided at the lower end of bottom wall 18.

In the space enclosed by the vertical wall 16*c*, a number of parallel air diffuser tubes 24 are provided to blow in primary air for forming the later-described fluidized bed. The air diffuser tubes 24 extend through the vertical wall 16*c*, outside the incinerator body 10, and are connected to a fluidizing air charging tube 26. On either side of each air diffuser tube 24, longitudinally spaced nozzle holes 25 are provided.

A duct 30 through which the refuse 18 is deposited onto the air diffuser tubes 24 is connected to the upper section wall 16*a* of the incinerator body 10, and a precipitator 31 is connected to the duct 30.

The precipitator 31 comprises a casing 34 connected to the duct 30 and a screw 36. The casing 34 comprises a hopper section 38 for the refuse 28. The refuse 28, introduced into the hopper section 38, is transferred to the duct 30 by the rotation of screw 36 via the duct 30 and is fed onto the air diffuser tubes 24.

On the upper section wall 16*a* of the incinerator body 10, a charging port 37 is provided to feed fluidizing medium such as sand into the incinerator body 10. This fluidizing medium 32 is fed onto the air diffuser tubes 24 through the charging port 37 from a later-described circulation unit.

Fluidizing air charging tube 26 is connected to a suitable air charging source (not shown) for supplying the air to the air diffuser tubes 24, so that air comes out, as shown by the arrows in figure, from each nozzle 25 of the air diffuser tubes 24. The refuse 28, along with the fluidizing medium 32 which is fed onto the air diffuser tubes 24, are fluidized by the incoming air to form the fluidized bed 40.

A screw conveyor 46 is connected to the discharge port 22 of incinerator body 10 for transferring the fluidizing medium 32 and the combustion residue of the refuse 28 to the separator 44 after these substances descend down through the gaps between the air diffuser tubes 24.

The separator 44 contains a sieve 48 which separates the fluidizing medium 28 from the combustion residue 42. The combustion residue 42 remains on the sieve 48 and is discharged from a discharge port 45 of the separator 44. The fluidizing medium 28, after passing through the sieve 48, is fed back to the fluidized bed 40 via the charging port 37 through a circulation line 50 which may include a vertical conveyor or the like which is connected to the separator 44.

In the upper section wall 16*a* which forms the combustion chamber 20 of the incinerator body 10, a number of nozzles 52 are installed in multiple stages in both vertical and horizontal directions.

The nozzles 52 are arranged in several vertical stages in the incinerator body 10. For example, the nozzles 52 can be installed in four stages as shown in the figure, where the lowest stage of nozzle group 52*a* and the third-stage nozzle group 52*c* are installed on one side face of incinerator body 1, while the second-stage nozzle group 52*b* and the fourth-stage nozzle group 22*d* are installed on the opposite wall face, and opposite the lowest stage nozzle group 52*a* and the third-stage nozzle group 52*c*.

Figure 2:
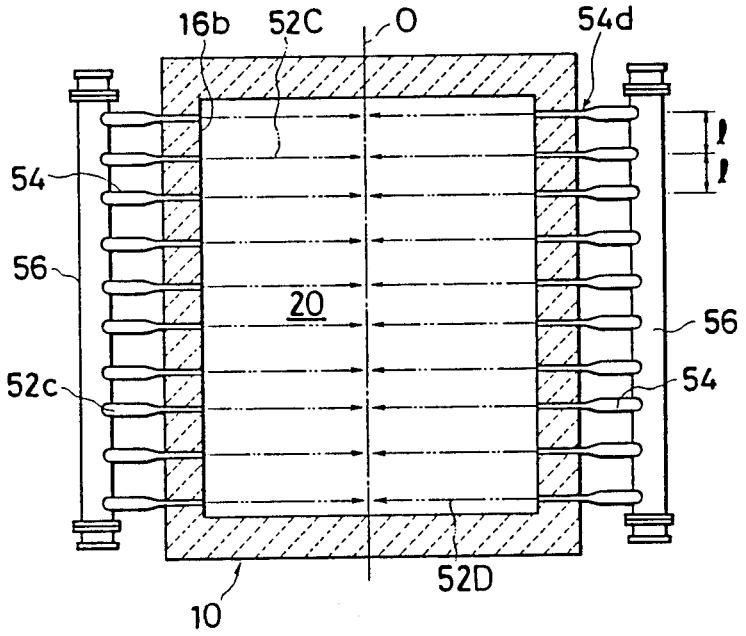
FIG. 2 is a sectional view taken along the line II—II of FIG. 1.

These opposed nozzle groups, 52*a* through 52*d*, are installed in a manner so as to form the secondary air flow, as shown by arrows 52A, 52B, 52C, and 52D respectively, which flows toward the centerline "0" of the incinerator body 10 as shown in the figure. Each nozzle group 52 is, as shown in FIG. 2, installed so that a number of the nozzles may be connected in parallel to the header 56 and each of these nozzles may pass through the upper wall 16*b* and face the interior of combustion chamber 20.

The nozzles 54 may be round, having an inside diameter of 40 to 80 mm or may be square ranging from 300 mm×60 mm to 40 mm×100 mm, and the horizontal interval "1" from nozzles is from 200 to 600 mm.

As shown in FIG. 1, both the secondary air charging tube 58 and the damper 60 are connected to the header tube 56 in each stage respectively. The secondary air supplied to the header 56 from the secondary air charging tube 58 is maintained at a pressure higher than 250 mm Hg by the damper 60, and the secondary air from each nozzle of 54 is blown across the combustion chamber 20, as indicated by the dotdash line in FIG. 2.

The lowest stage nozzle group 52*a* is mounted in a position such that the height "h" from the upper face of the fluidized bed 40 to the air flow 52 from those nozzles is 0.1 to 1.5 m.

The primary air blown out of the air diffuser tubes 24 and the secondary air blown out of the nozzle groups 52*a*–52*d* are adjusted to form a ratio of from 1:3 to 3:2, or preferably the ratio of 1:1, and further, the ratio of the total air thus supplied to the theoretical volume of air required for combustion of the refuse is adjusted to be in the range of 1.4:1 to 1.7:1.

The method for burning the refuse in the aforementioned fluidized bed incinerator will be described. The refuse 28 is fed onto the air diffuser tubes 24 inside the incinerator body 10, from the precipitator 32 via the duct 30, and the fluidizing medium 32 is fed from the circulation unit 50 via the charging port 37.

The fluidizing air is fed to each of the air diffuser tubes 24 from the fluidizing air charging tube 26, and the primary air is blown out through the nozzles 25 of the air diffuser tubes 24, as shown by the arrow in the figure.

The refuse 28 and the fluidizing medium fed onto the air diffuser tubes 24 are fluidized by the primary air blown out of the tube nozzles 25.

A number of start-up burners (not shown) are installed inside the incinerator body 10 and the refuse 28 inside the fluidized bed 40 is initially burned by the flames from these burners during start-up of the incinerator operation.

After the refuse 28 inside the fluidized bed 40 commences being burned with the fluidizing air, the ignition by the burners is terminated. The flame directed toward the fluidized bed 40 is formed over the entire surface of the fluidized bed 40 as a result of the air flow 52 which is blown out in a grid shape from the lowest stage nozzle group 52*a*. Not only can the flame over the fluidized bed 40 be controlled in this manner, but the pyrolysis gas generated by the thermal decomposition of the refuse can also be dispersed uniformly.

The combustion heat of the refuse 28 in the fluidized bed 40 causes some of the refuse 28 to be decomposed into the pyrolysis gas. This pyrolysis gas, containing combustible gases such as $H_2$, CO and hydrocarbonaceous gases, is secondarily burned by the secondary air blown in from the nozzles 54 in the upper part of the combustion chamber 20 inside the incinerator body 10.

The combustible gas thus produced, while ascending in the combustion chamber 20, is burned completely by the secondary air 52B, 52C and 53D which is blown into the combustion chamber in a grid-shaped pattern by the nozzle groups 52*b*, 52*c* and 52*d* at the rate of 50 m/sec. Since the secondary air 52B, 52C and 52D is blown in a grid-shaped pattern at several vertically spaced stages, the interior of the combustion chamber 20 is essentially completely filled with the secondary air, and the combustible gas rising form the fluidized bed 40 is prevented from blowing through the grids of incoming secondary air. Thus, the combustible gas can be entirely burned positively, swiftly and stably in combustion chamber 20.

Further, the ratio of the total volume of air required for combusting the refuse 28 to the theoretical air volume for combusting the refuse 28, which in the conventional method is 1.7 to 2.0, can be lowered to 1.4 to 1.7 by this invention, while the temperature inside the combustion chamber can be maintained at a high level.

The exhaust gas which is generated by the combustion of the refuse 28 and by the secondary combustion of pyrolysis gas, exits from the incinerator through the exhaust port 19. Because it contains a high caloric value, this exhaust gas may be used as the heat source for heating water for boilers, etc. No smut is contained in the exhaust gas, because dust is removed by an electric precipitator after it is used as the heat source.

The refuse 28 and the fluidizing medium 32 are fed sequentially to the fluidized bed 40, and the refuse 28 is burned and decomposed as mentioned earlier.

The fluidizing medium 32 promotes the agitation and dispersion of refuse 28 and also forms a moving bed which descends inside the fluidized bed 40. Thereafter, the fluidizing medium 32 flows down along with the combustion residue 42 through the gaps between the air diffuser tubes 24, and remain on the bottom wall 18 to form a filling bed below the air diffuser tubes 24. This filling bed regulates the level of the fluidized bed 40 which is formed over the air diffuser tubes 24. The filling bed, which is increased by the combustion residue, is discharged by a screw conveyor 46. The screw conveyor 46 transfers the fluidizing medium 32 and the combustion residue 42 to the separator 44.

In the separator 44, the combustion residue 42 is separated from the fluidizing medium 42 by the sieve 48, and the combustion residue 42 is then discharged through the discharge port 45 while the fluidizing medium 32 is fed back to the fluidized bed 40 through the circulation line 50.

Figure 3:
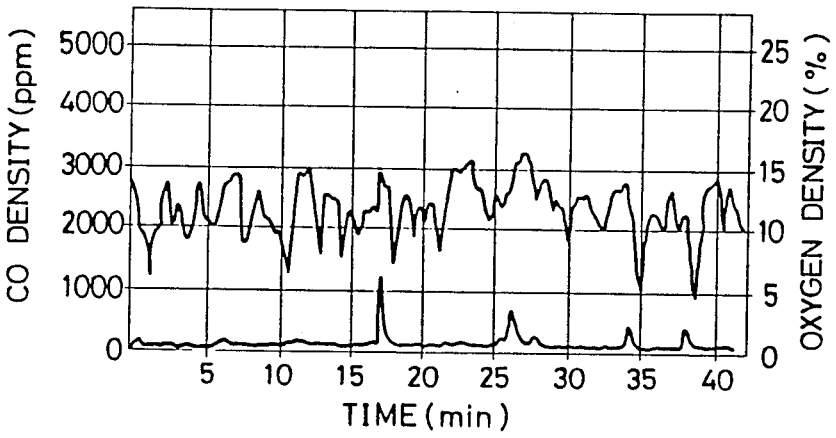
FIG. 3 is a graph showing the chronological change of CO gas and $O_2$ gas densities within the exhaust gas of the incinerator.
Figure 5:
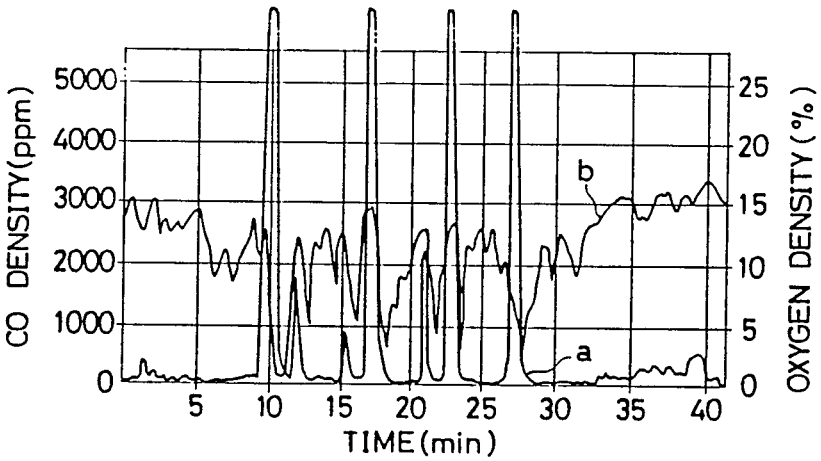
FIG. 5 is a graph showing the chronological change in CO gas and $O_2$ gas densities in the exhaust gas in the case of a conventional method of combustion.

FIG. 3 and FIG. 5 show examples of the chronological change of CO gas density and $O_2$ gas density when the refuse is burned in the fluidized bed incinerators, according to the present invention and the conventional prior art manner, respectively. Municipal wastes were used as refuse in both cases and were fed at the rate of 2.5 tons/hour, however, the methods of blowing in secondary air were different from each other. In the example in FIG. 3, the temperature of the fluidized bed is controlled to 600° C.

In the conventional example (FIG. 5), the CO gas, which comprises a portion of the pyrolysis gas, whose density is represented as "a", is periodically produced at a density higher than 5,000 ppm as shown in FIG. 5, and the oxygen density "b" on that occasion also becomes lower than 5%. This means that the refuse is not stably burned inside the fluidized bed and that a large amount of pyrolysis gas represented by CO gas is generated due to the changes in quality or volume of the refuse or temperature of the fluidized bed, and it is known that the supply of secondary air for combustion of these gases cannot follow these changes, so that the oxygen density decreases, thereby resulting in an oxygen shortage.

In contrast, a favorable mixture of the pyrolysis gas rising out of the fluidized bed with the secondary air is achieved in this invention, and sufficient secondary combustion is carried out in the combustion chamber section, so that the combustion inside the incinerator can be completed and the CO gas density "ao" can be suppressed to 1,000 ppm or below, at minimum, as shown in FIG. 3, and the oxygen density "bo" can be reduced to around 10%, thus causing the pyrolysis gas to be stably burned.

Figure 4:
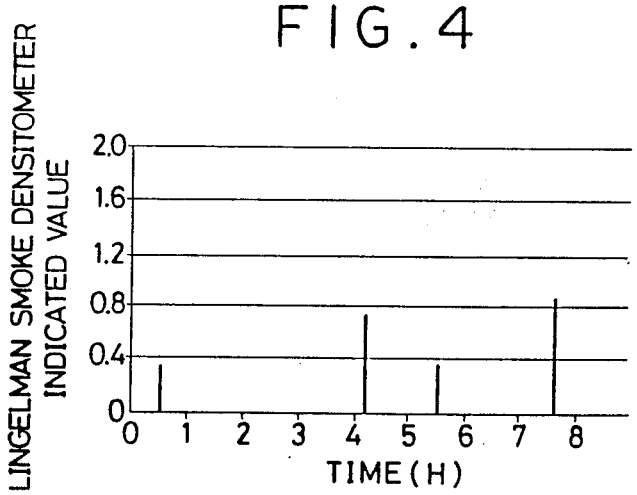
FIG. 4 is a graph indicating the chronological change in the smut produced in accordance with the method of this invention.
Figure 6:
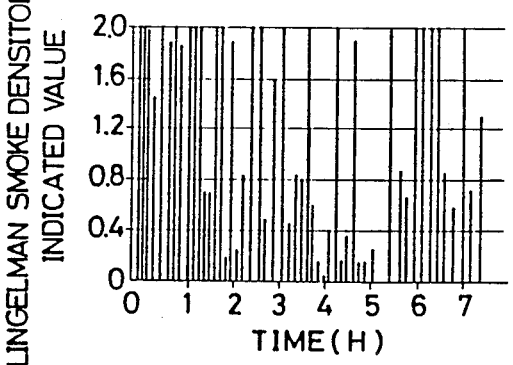
(PRIOR ART) FIG. 6
FIG. 6 is a graph indicating the chronological change of the smut produced in a conventional method of combustion.

FIG. 4 and FIG. 6 respectively show the chronological changes in generated smut for operation with the method of the present invention in which the temperature of the fluidized bed was controlled, and for operation with the conventional method. Smut comprising smoke was measured by a Lingelman smoke density indicator in both examples, after the exhaust gas coming out of the fluidized bed incinerator cooled down in the gas cooling unit and the dust was removed by an electric precipitator.

As indicated in FIG. 6, smoke with an indicated value higher than the critical point for vision (0.5) is exhausted for a considerable period in the conventional example. In the present invention, however, smoke with a value higher than the critical point for vision (0.5) is exhausted only rarely, as shown in FIG. 4.

It will be appreciated from the foregoing disclosure that this invention provides the following benefits and advantages:

1. As the secondary air is blown into the fluidized bed incinerator, the pyrolysis gas generated by the thermal decomposition of the refuse is secondarily burned in a desired manner by providing several stages of horizontally-oriented nozzle groups which are vertically spaced in the combustion chamber and blow in the secondary air in a grid-shaped pattern.

2. The fluidized bed temperature can be controlled (mainly by being heated) with the secondary combustion flame by installing the lowest stage nozzle group to supply the air close to the upper surface of the fluidized bed.

3. Since the burning of pyrolysis gas in the lower section of the combustion chamber inside the incinerator can be done quickly, the combustible gas temperature within the combustion chamber can be maintained at a high level.

We claim:

1. A method of operating a fluidized bed incinerator which promotes secondary combustion of combustible gases generated in the fluidized bed, comprising the steps of:

(a) forming a fluidized bed in said incinerator by fluidizing refuse and a fluidizing medium with primary air, the primary air being blown into the fluidized by air diffuser tubes provided in the lower part of the incinerator, the air diffuser tubes extending generally parallel to each other;

(b) feeding the refuse and the fluidizing medium into said fluidized bed;

(c) burning and thermally decomposing the refuse inside the fluidized bed, the burning and decomposition of said refuse resulting in the generation of combustible gas inside said incinerator;

(d) forming a downward flow of the combination of the combustion residue of said refuse and the fluidizing medium inside the fluidized bed through the air diffuser tubes, and discharging said combination from the bottom of the incinerator;

(e) separating the fludizing medium from the combustion residue in a sieve, and then recirculating the separated fluidizing medium to the fluidized bed;

(f) supplying secondary air into a combustion chamber inside said incinerator for performing secondary combustion of said combustible gas, the supplying of said secondary air being performed by blowing said secondary air into said combustion chamber and horizontally across said combustion chamber through a plurality of groups of nozzles arranged in vertically staggered stages, the nozzles in each group being arranged in several horizontal rows, groups of the nozzles being alternately located in a pair of opposing side walls and forming parallel, staggered streams of air directed toward an opposite one of said side walls; and (g) generating a vortex of a mixture of the combustible gas and the secondary air in each space between two horizontal streams of the secondary air in each space between two horizontal streams of the secondary air supplied through two groups of nozzles provided in said opposing side walls.

2. The method of claim 1, wherein said fluidizing medium comprises sand.

3. The method of claim 1, wherein the secondary air blown into said combustion chamber through the group of nozzles in the lowest stage thereof is directed toward the flames from the refuse within the fluidized bed and disperses the flames uniformly, resulting in the production of another flame with resulting combustible gas and heating the fluidized bed with radiant heat generated thereby.

4. The method of claim 3, wherein at least a portion of the secondary air is supplied into said combustion chamber at a distance of between 0.1 and 1.5 meters from the upper surface of said fluidized bed.

5. The method of claim 1, wherein the secondary air is supplied into said combustion chamber by the nozzles in each group thereof at intervals of between 200 and 600 mm.

6. The method of claim 1, wherein the nozzles of each nozzle group are connected to a header, and the secondary air is supplied to said header at a pressure higher than 250 mm Hg in order to blow the secondary air out of each nozzle.

7. The method of claim 1, wherein the total air volume of the primary air and the secondary air is from 1.4 to 1.7 times of that of the theoretical volume of air required to combust the refuse.

8. The method of claim 7, wherein primary and secondary air are supplied approximately in the ratio of 1:1.

9. A method for combusting combustible gases in the combustion chamber of a fluidized bed incinerator of the type in which the burning and thermal decomposition of refuse introduced into a fluidized bed results in the generation of said combustible gas, and wherein the fluidized bed is formed by fluidizing said refuse and a fluidizing medium with primary air, comprising the steps of:

(a) introducing pressurized secondary air into said combustion chamber so as to create a plurality of groups of vertically staggered horizontal streams of secondary air, said groups of horizontal streams being vertically spaced, half of said groups of horizontal streams of secondary air blowing from one side wall, the other half of the groups of horizontal streams blowing from the opposite side wall, two adjacent groups of said horizontal streams blowing in the opposite directions; and, (b) generating a vortex of a mixture of the combustible gas and the secondary air between said two adjacent air streams by supplying the secondary air so to horizontally flow in said opposite directions.

10. The method of claim 9, including the step of directing the air streams of the stage nearest said fluidized bed toward the flames emanating from said fluidized bed and in a manner to disperse said flames essentially uniformly.

11. The method of claim 9, wherein at least a portion of said secondary air is introduced into said combustion chamber at a point between approximately 0.1 and 1.5 meters above said fluidized bed.

12. The method of claim 9, wherein said parallel air streams are formed approximately between 200 and 800 mm from each other.

13. The method of claim 9, wherein the total volume of the primary and secondary air respectively supplied to said fluidized bed and said combustion chamber is from 1.4 to 0.7 times the theoretical volume of air required to combust said refuse.

14. The method of claim 9, wherein the primary air and the secondary air are respectively supplied to said fluidized bed and said combustion chamber in the ratio of approximately 1:1.

15. A fluidized bed incinerator having a fluidized bed for combusting refuse, comprising:

an incinerator body;

a plurality of parallel air diffuser tubes in a lower section of said body, each of said tubes having a plurality of openings on opposite sides thereof for supplying primary combustion air to said fluidized bed;

means for supplying said primary combustion air to said tubes;

means for introducing refuse onto said fluidized bed above said tubes, the thermal decomposition of said refuse in said fluidized bed resulting in the generation of pyrolysis gas;

means below said tubes for removing combustion residue and a fluidizing medium from said lower section of said incinerator body;

means for separating said combustion residue from said fluidizing medium;

means for circulating the separated fluidizing medium back to said fluidized bed; and a plurality of groups of nozzles for supplying secondary air horizontally cross said incinerator body, said nozzles being vertically staggered and disposed in two opposing side walls in an upper section of said body, two adjacent streams of said secondary air having different vertically spaced paths, said nozzles in each group being arranged in a plurality of horizontal rows.

16. The fluidized bed incinerator of claim 15, wherein said each group of nozzles is connected to a header attached to the outer surface of the side wall which the group of nozzles is located in, each nozzle penetrating the side wall and being directed toward the opposite side wall, said headers being provided with secondary air supply.

17. The fluidized bed incinerator of claim 16, wherein a damper means is provided between said secondary air supply and said headers in order to control the amount of secondary air to be supplied.

18. The fluidized bed incinerator of claim 17, wherein the pressure of the secondary air in said header is maintained higher than 250 mmHg.

19. The fluidized bed incinerator of claim 16, wherein the bottom group of said nozzles is located 0.1 to 1.5 meters above the uppermost surface of said fluidized bed.

* * * * *